US006932139B2

(12) United States Patent
Early et al.

(10) Patent No.: US 6,932,139 B2
(45) Date of Patent: Aug. 23, 2005

(54) INSULATED GLASS WINDOW BLIND

(75) Inventors: Keith P. Early, Wyoming, MI (US); Dean M. Dykstra, Holland, MI (US)

(73) Assignee: ODL, Incorporated, Zeeland, MI (US)

( * ) Notice: Subject to any disclaimer, the term of this patent is extended or adjusted under 35 U.S.C. 154(b) by 33 days.

(21) Appl. No.: 10/635,757

(22) Filed: Aug. 6, 2003

(65) Prior Publication Data

US 2005/0028944 A1 Feb. 10, 2005

(51) Int. Cl.[7] ..... E06B 3/32
(52) U.S. Cl. ..... 160/107; 160/84.06
(58) Field of Search ..... 160/107, 84.06, 160/34, 168.1 R, 170, 171, 172 R

(56) References Cited

U.S. PATENT DOCUMENTS

| | | | | |
|---|---|---|---|---|
| 2,389,956 A | | 11/1945 | Castilonia | |
| 2,557,978 A | | 6/1951 | Krumm | |
| 2,639,766 A | | 5/1953 | Pratt | |
| 3,201,832 A | | 8/1965 | Hordis et al. | |
| 3,253,644 A | * | 5/1966 | Kazuo et al. | 160/107 |
| 3,318,360 A | | 5/1967 | Persson | |
| 3,342,243 A | | 9/1967 | Salter | |
| 3,443,624 A | | 5/1969 | Toth | |
| 3,703,920 A | | 11/1972 | Debs | |
| 3,719,221 A | | 3/1973 | Hanson | |
| 3,795,267 A | | 3/1974 | Debs | |
| 4,459,778 A | | 7/1984 | Ball | |
| 4,588,012 A | | 5/1986 | Anderson | |
| 4,664,169 A | | 5/1987 | Osaka et al. | |
| 4,679,610 A | | 7/1987 | Spraggins | |
| 4,817,698 A | * | 4/1989 | Rossini et al. | 160/107 |
| 4,825,929 A | * | 5/1989 | Haines | 160/84.06 |
| 4,979,552 A | | 12/1990 | van der Zanden | |
| 5,178,200 A | | 1/1993 | Hagen | |
| 5,226,466 A | | 7/1993 | Coddens | |
| 5,379,825 A | | 1/1995 | Jelic | |
| 5,396,944 A | | 3/1995 | Rossini | |
| 5,699,845 A | | 12/1997 | Jelic | |
| RE35,926 E | | 10/1998 | Hagen | |
| 5,826,638 A | | 10/1998 | Jelic | |
| 6,601,633 B2 | * | 8/2003 | Sun et al. | 160/107 |

FOREIGN PATENT DOCUMENTS

| | | |
|---|---|---|
| FR | 2646205 | 10/1990 |
| FR | 2672335 | 8/1992 |
| WO | WO 90/15914 | 12/1990 |

* cited by examiner

*Primary Examiner*—Blair M. Johnson
(74) *Attorney, Agent, or Firm*—Warner Norcross & Judd LLP

(57) ABSTRACT

An insulated glass window assembly including an integral shade that can be raised and lowered at both its upper and lower edges. The assembly includes an insulated glass, a frame for mounting the insulated glass within a supporting structure, the shade within the glass, and operator bars outside the glass. The operator bars are magnetically coupled through the glass to the upper and lower edges of the shade. Accordingly, the upper and lower edges can both be raised and lowered independently to provide a wide variety of positioning options.

9 Claims, 7 Drawing Sheets

INSULATED GLASS WINDOW BLIND

BACKGROUND OF THE INVENTION

The present invention relates to window blinds, and more particularly to window blinds contained within insulated glass.

Insulated glass window assemblies with internal windows blinds are well known. The insulated glass includes two spaced glass panels sealed to a spacer frame to define a space between the panels. The window blind is positioned within the space and is operated by actuators that are outside of the insulated glass but magnetically coupled to the blind. An example of such a construction is illustrated in U.S. patent application Ser. No. 09/971,246 filed Oct. 4, 2001 by Sun et al, the disclosure of which is incorporated by reference.

While a wide variety of insulated glass window blinds are known, the market continually desires new concepts, constructions, and features.

SUMMARY OF THE INVENTION

The aforementioned need is met by the present invention in which an insulated glass window covering (such as a blind or a shade) can be raised and lowered at both its upper and lower ends. More particularly, the covering within the insulated glass includes upper and lower inner bars at the top and bottom, respectively, of the covering. Upper and lower outer bars are positioned outside the insulated glass and are magnetically coupled to the upper and lower inner bars, respectively, inside the insulated glass. Both the top and bottom of the window covering can be raised and lowered independently of one another to permit a variety of opening, closing, and positional options.

In a preferred embodiment, the bars include rollers to facilitate the movement of the bars.

These and other objects, advantages, and features of the invention will be more fully understood and appreciated by reference to the detailed description of the preferred embodiments and the drawings.

DETAILED DESCRIPTION OF THE PREFERRED EMBODIMENTS

Figure 1:
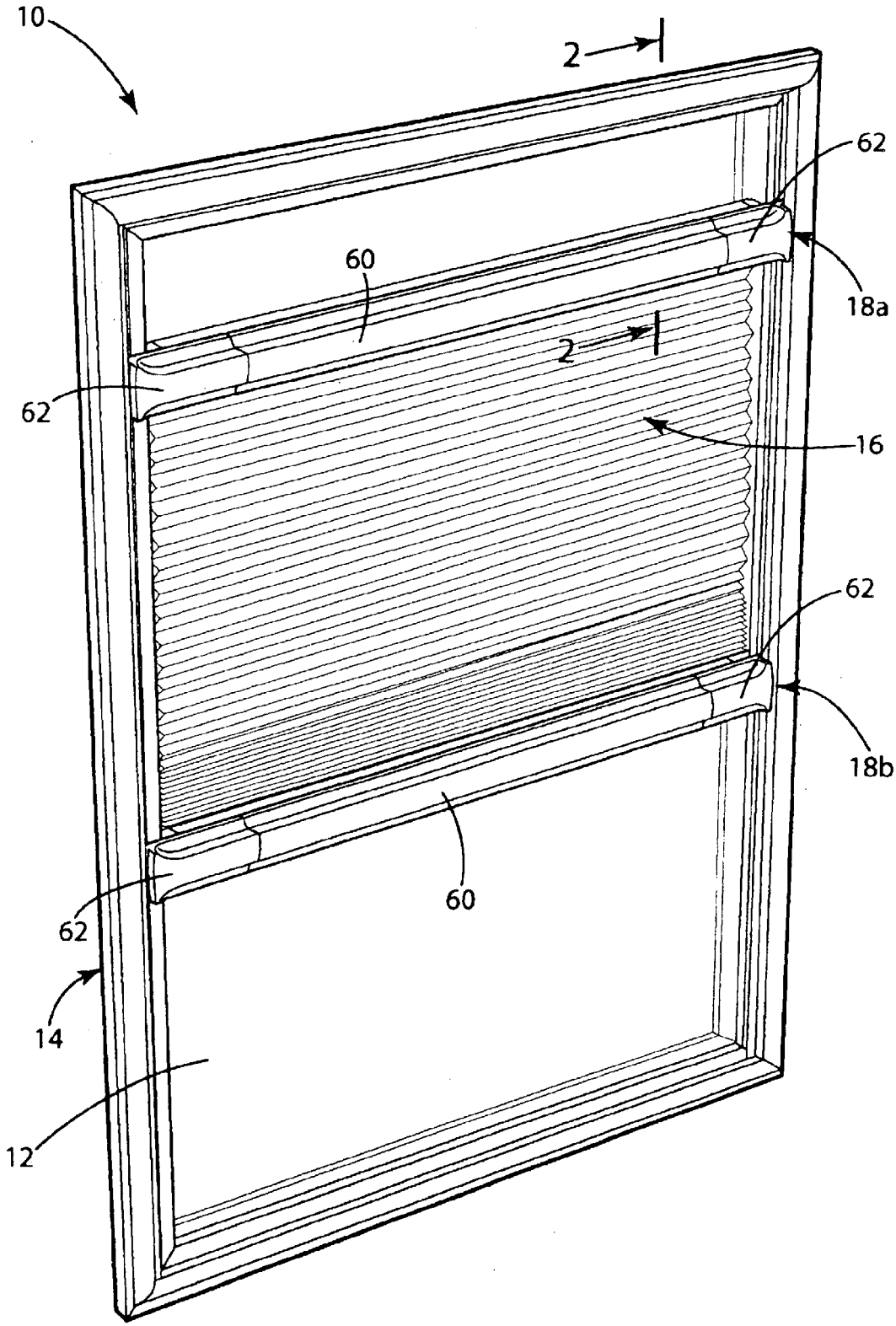
FIG. 1 is a perspective view of the insulated glass window assembly of the present invention.

An insulated glass window assembly constructed in accordance with a preferred embodiment of the invention is illustrated in FIGS. 1–6 and generally designated 10. The insulated glass window assembly includes an insulated glass 12, a frame 14, a shade assembly 16, and outer bars 18*a* and 18*b*. The shade assembly 16 is contained within the insulated glass 12. The insulated glass 12 is supported within a supporting structure D (see FIG. 2) by the frame 14. The outer bars 18*a* and 18*b* are magnetically coupled to the shade assembly 16 to enable the raising and lowering of the upper and lower portions of the shade.

The insulated glass 12 is of any type well known to those skilled in the art. The insulated glass includes a pair of glass panels 30 and 32 sealed to a common spacer 34.

The frame 14 is of a type generally well known to those skilled in the art. In the preferred embodiment, the frame is injection molded of plastic. Alternative materials and manufacturing techniques may be used. The frame 14 includes two frame halves 40*a* and 40*b*, which are interconnected using screws or other techniques well known to those skilled in the art. Each of the frame halves 40*a* and 40*b* has a visible surface or profile 38 providing an aesthetically pleasing appearance. The frame halves 40*a* and 40*b* can optionally be sealed, for example as illustrated at 42, against the supporting structure D and/or the insulated glass 12.

Figure 2:
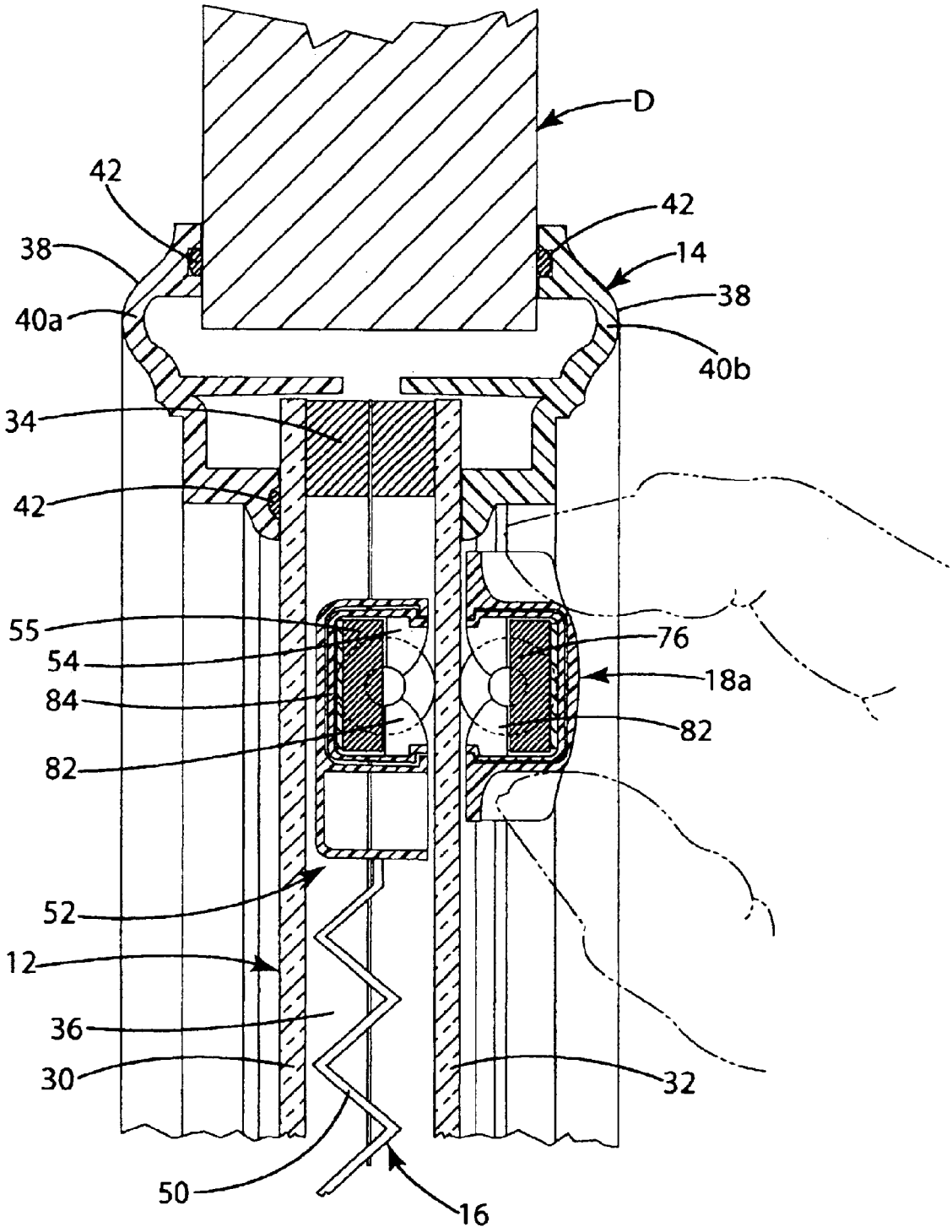
FIG. 2 is a fragmentary sectional view taken along line II—II in FIG. 1.
Figure 3:
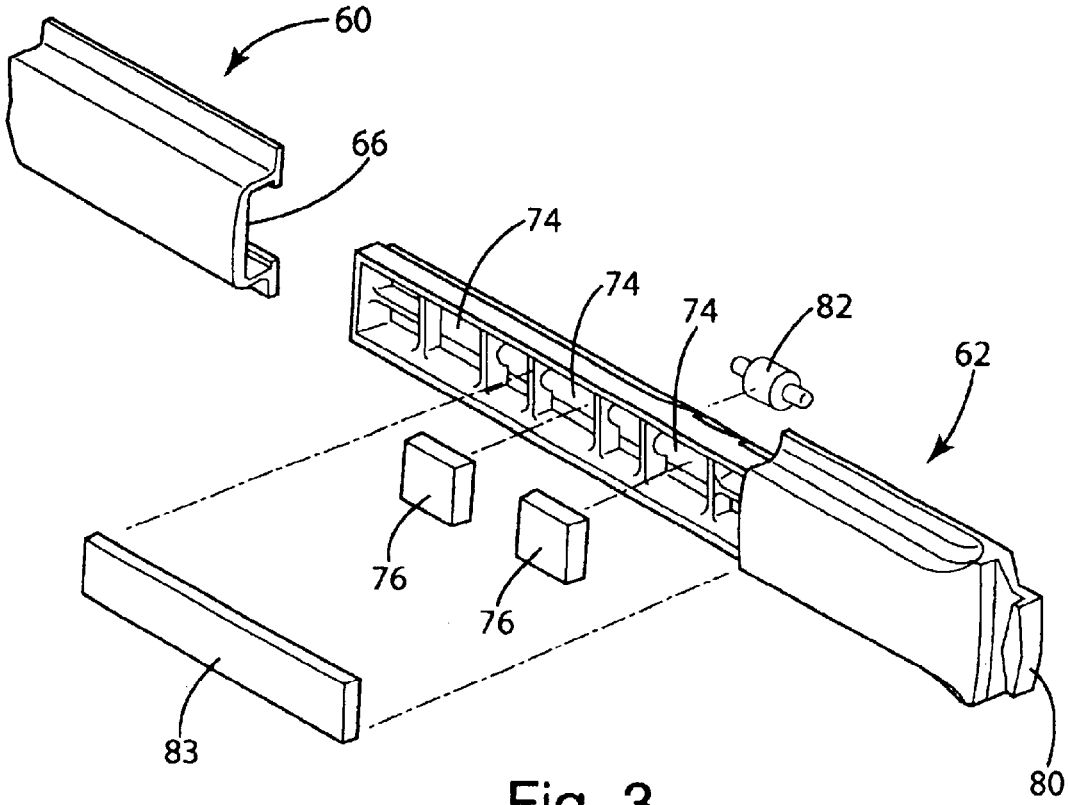
FIG. 3 is a fragmentary exploded front perspective view of one end of the outer bar.
Figure 4:
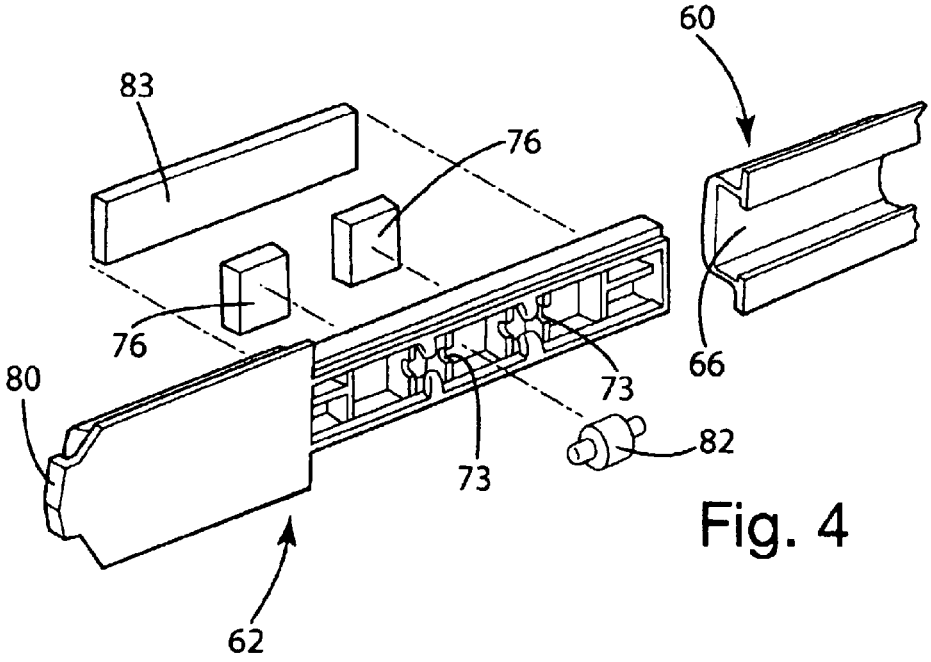
FIG. 4 is a fragmentary exploded rear perspective view of the same end of the outer bar.

As illustrated in FIG. 2, the frame 14 supports the insulated glass 12 within a supporting structure D. In the disclosed embodiment, the window 10 is a doorlight specifically adapted for installation within a door. Consequently, the supporting structure D is a door. However, the invention is usable in conjunction with windows generally, including those supported by a building structure.

Figure 5:
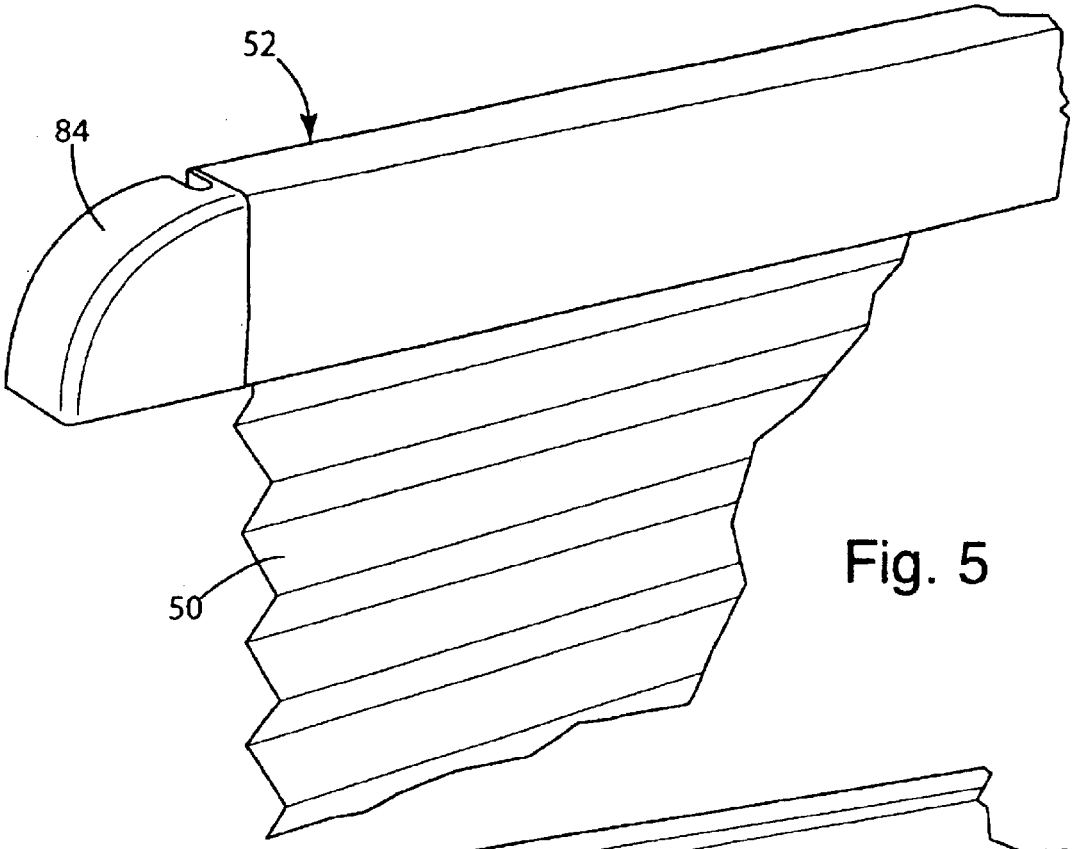
FIG. 5 is a fragmentary perspective exploded view of the upper portion of the shade.
Figure 6:
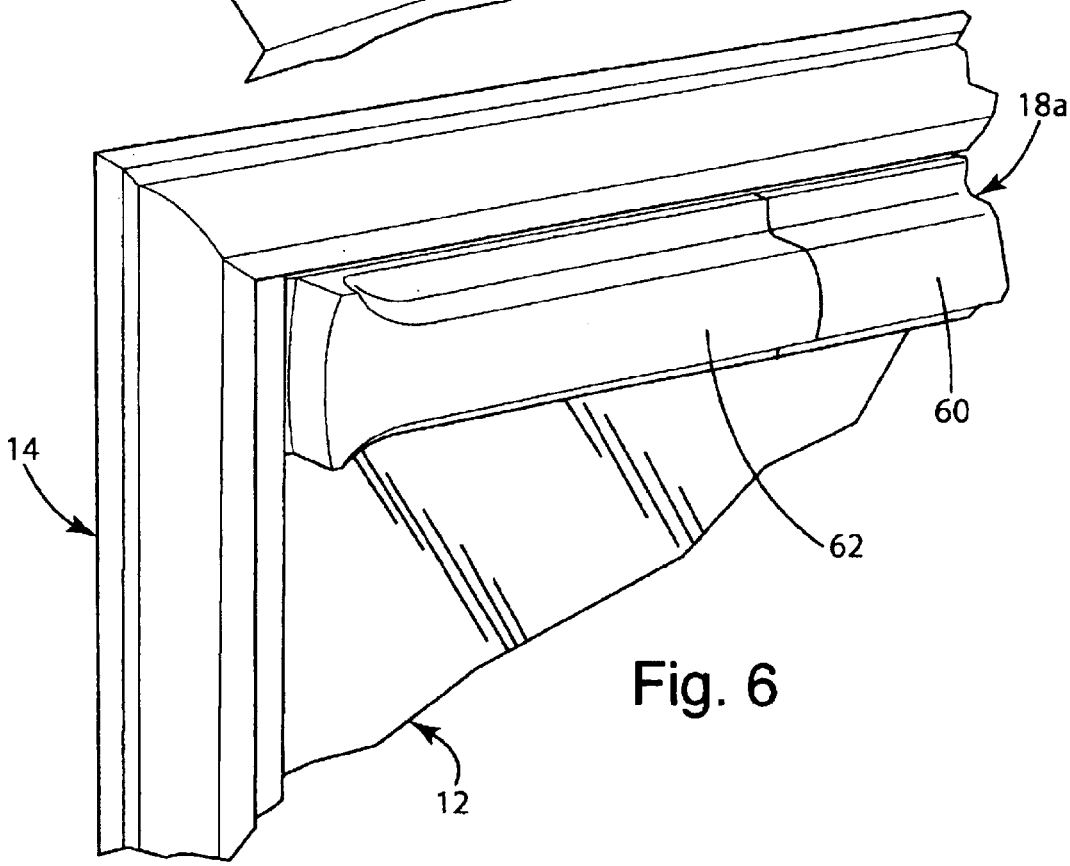
FIG. 6 is a fragmentary perspective view showing the upper outer bar in its fully raised position.

The window shade assembly 16 is illustrated most clearly in FIGS. 2 and 5. The shade assembly includes a pleated shade 50, an upper inner bar 52, and a lower inner bar (not visible) that is identical to, but inverted from, the upper bar 52. The pleated shade 50 and its attachment to the inner bars are well known to those skilled in the window covering art. Although a pleated shade is disclosed, a wide variety of window coverings could be substituted therefor. For example, the pleated shade could be a slatted blind or a fabric.

The upper inner bar 52 is extruded of plastic and defines a slot 54 facing the glass panel 32. Magnets 55 are secured within the inner end caps 84 in the slots 54 in the upper inner bar 52 and the lower bar (not visible). Rollers 82 are rotatably supported within the inner end caps 84 in the slots 54 in the upper and lower inner bars. The rollers ride against the glass panel to facilitate the movement of the inner bars.

The upper outer bar 18*a* (FIGS. 1–4 and 6) is located outside of the insulated glass 12. The upper bar includes an extrusion 60 and a pair of end caps 62. The extrusion defines a channel 66 within which the end caps 62 are received. The upper outer bar 18*a* extends horizontally between the opposite sides of the frame 14 for vertical movement.

Each end cap 62 is injection-molded plastic and defines roller pockets 73 and three magnet pockets 74. The end cap 62 is shaped and sized to fit closely within the extrusion 60. Magnets 76 are secured within the magnet pockets 74. A steel back plate 83 is attached to the magnets 76 to improve magnetic attraction. A roller 82 is snap-fitted within the roller pocket 73 to provide rolling engagement, and thereby reduced friction, between the bar and the glass. The end cap 62 further includes a side flange 80 which rides within a groove defined by the frame 14 between the glass 12 and the frame as disclosed in U.S. application Ser. No. 09/971,246 filed Oct. 4, 2001, the disclosure of which is incorporated by reference. Alternatively, the side flange 80 could ride within a metal track (not shown).

The magnets 76 on the outer bars 18 are magnetically coupled to the magnets 55 on the inner bars 52 so that movement of the outer bars results in movement of the inner bars (and hence the shade 16) within the insulated glass 12.

The upper portion of the pleated shade 16 can be raised and lowered by moving the upper outer bar 18*a* upwardly or downwardly. To do so, the user places her fingers on the outer bar 18 and provides upward or downward pressure. The magnetic coupling between the bars 18*a* and 52 is adequate so that the bar 52 follows the bar 18*a* throughout its extent of movement.

Similarly, the lower portion of the shade 16 can be raised and lowered by moving the bottom outer bar 18*b*. This bar is moved in the same fashion as the upper bar 18*a*. Again, the magnetic attraction between the lower outer bar 18*b* and the lower pleated shade bar is sufficient to cause the lower shade bar to follow the lower outer bar 18*b* throughout its extent of travel. By moving the lower outer bar 18*b* upwardly as illustrated in FIG. 1, the lower portion of the window can be exposed.

As described, the shade assembly 16 can be moved entirely to the top of the window assembly 10, entirely to the bottom of the window assembly, or to any point in between. The upper and lower outer bars 18*a* and 18*b* are independently adjustable to position the upper and lower portions of the blind at selected locations.

ALTERNATIVE EMBODIMENTS

Figure 7:
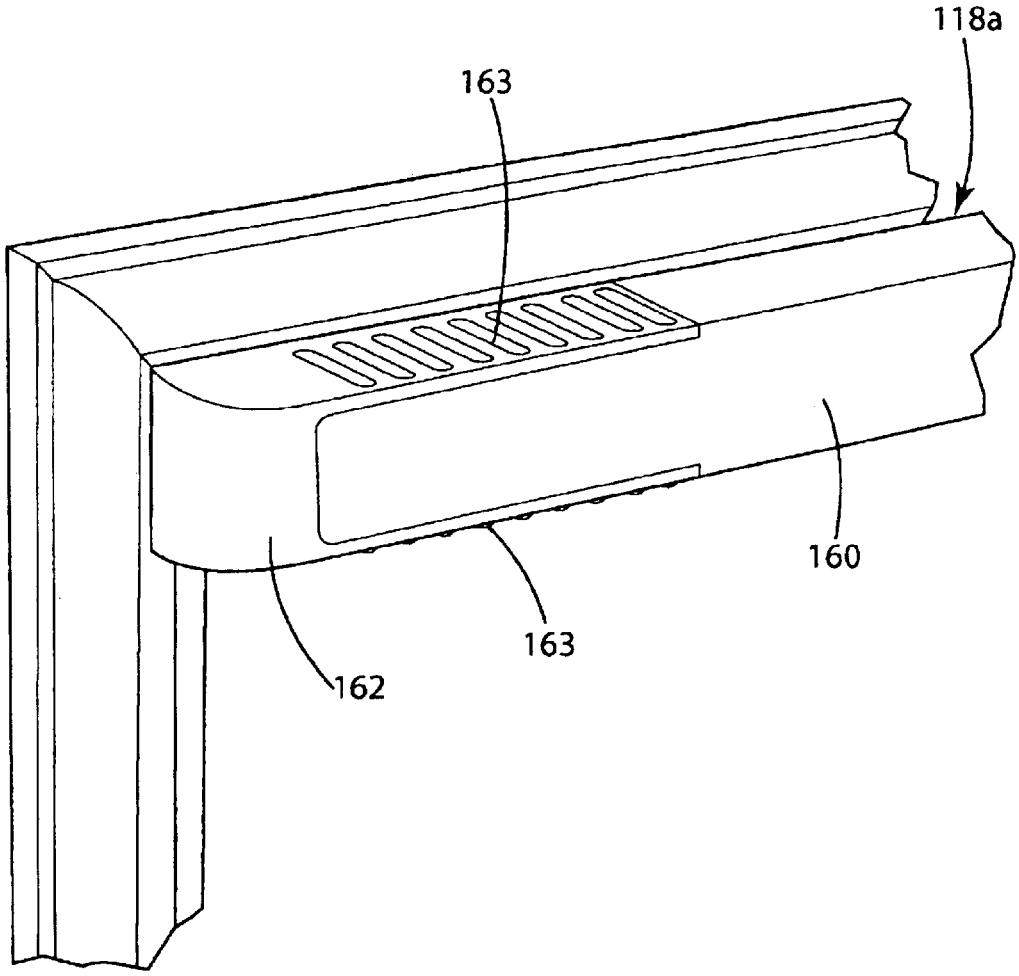
FIG. 7 is a fragmentary perspective view of a first alternative embodiment of the upper outer bar.

A first alternative embodiment 118*a* is illustrated in FIG. 7. This embodiment includes an extrusion 160 and an end cap 162. The extrusion 160 is aluminum and the end cap 162 is injection molded plastic. As in the previously described embodiment, the end of the extrusion 160 and the end cap 162 are cooperatively shaped to provide a close fit when the end cap 162 is mounted on the extrusion 160. The end cap 162 includes a gripping portion 163 comprising a plurality of ribs of low-durometer material. The gripping portion 163 can be co-molded with the end cap 162 or applied in a subsequent operation. The outer bar 118*a* is actuated by grasping the gripping portions 163.

Figure 8:
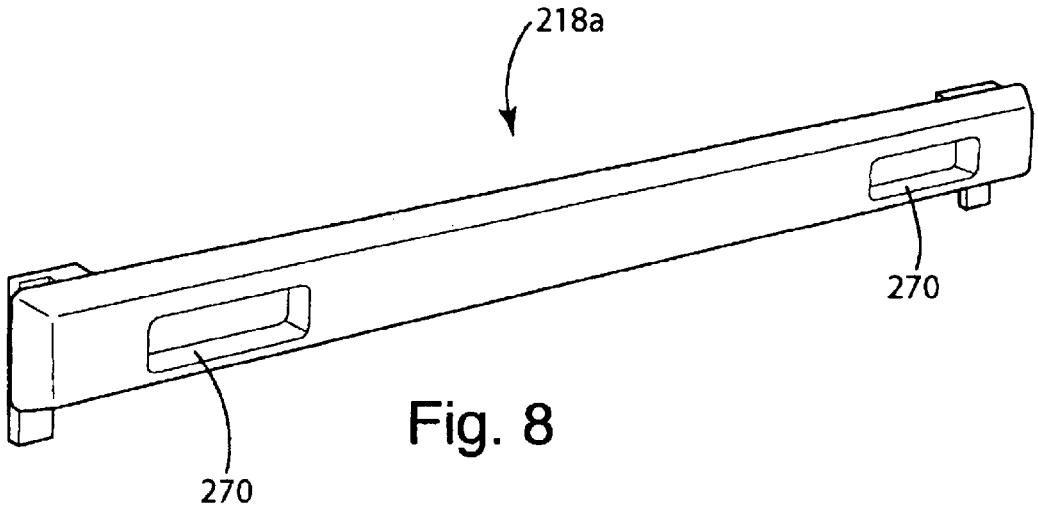
FIG. 8 is a front perspective view of a second alternative embodiment of the upper outer bar.
Figure 9:
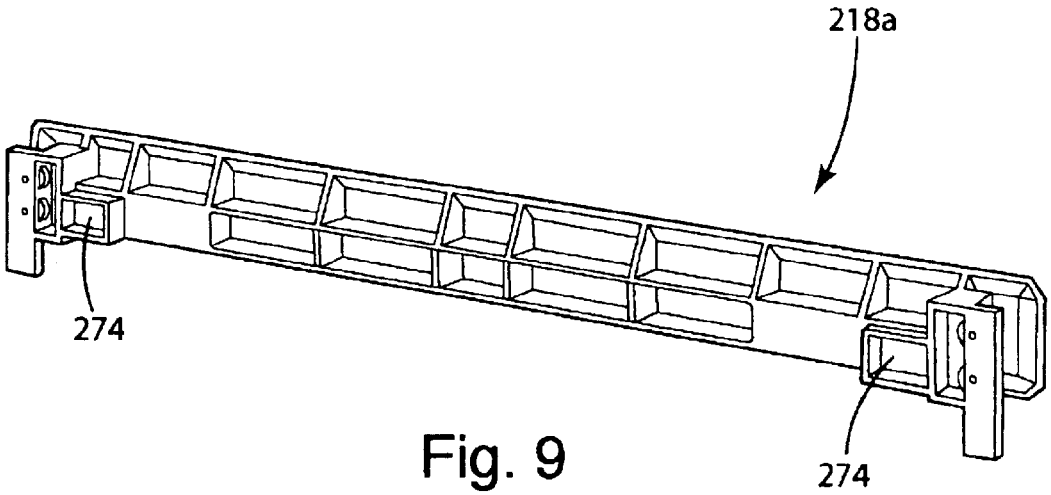
FIG. 9 is a rear perspective view of the second alternative embodiment of the upper outer bar.

A second alternative embodiment 218*a* of the upper outer bar is illustrated in FIGS. 8 and 9. The bar 218*a* is injection molded as an integral piece and includes integral finger pocket 270 and magnet pockets 274. The geometry of the ends of the bar 218*a* is nearly identical with that of the bar 18*a* to interfit with the window frame 14.

Figure 10:
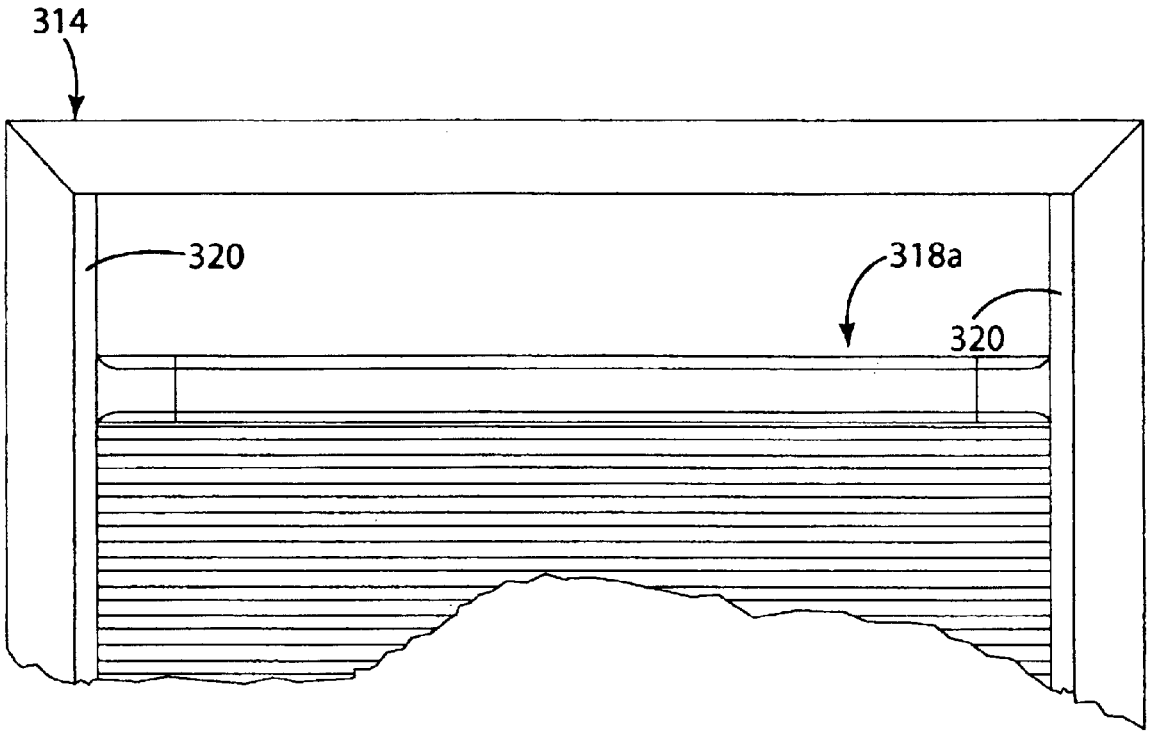
FIG. 10 is a fragmentary plan view of the upper portion of the insulated glass assembly including a third alternative embodiment of the upper outer bar.

A third alternative embodiment of the upper bar 318*a* is illustrated in FIG. 10. In this embodiment, a pair of metal tracks 320 are secured to the window frame 314 to provide the grooves in which the opposite ends of the bar 318*a* travel.

The above descriptions are those of preferred embodiments of the invention. Various alterations and changes can be made without departing from the spirit and broader aspects of the invention, which are to be interpreted in accordance with the principals of patent law, including the Doctrine of Equivalents.

The embodiments of the invention in which an exclusive property or privilege is claimed are defined as follows:

1. An insulated glass window assembly comprising:

an insulated glass defining an interior space, said insulated glass having a pair of opposite exterior glass surfaces;

a window covering within said interior space, said covering including upper and lower inner bars, said covering further including at least one inner magnet on each of said upper and lower inner bars, both of said upper and lower inner bars being vertically movable within said insulated glass;

a window frame adapted to support said insulated glass within a supporting structure;

upper and lower outer bars proximate one of said exterior glass surfaces, each of said upper and lower outer bars including at least one outer magnet magnetically coupled to said inner magnets on said upper and lower inner bars, respectively, whereby said upper and lower inner bars can be moved vertically by vertical movement of said upper and lower outer bars, respectively; and roller means on selected ones of said bars for facilitating movement of said selected ones of said bars.

2. An insulated glass window assembly as defined in claim 1 wherein said upper and lower bars define finger locations to facilitate operation.

3. An insulated glass window assembly as defined in claim 1 wherein:

said frame defines grooves; and each of said upper and lower outer bars includes portions riding within said grooves.

4. An insulated glass window assembly comprising:

an insulated glass having a pair of spaced glass panels each having an exterior surface, said panels defining a space therebetween;

a window covering within said space, said window covering including an upper actuating portion and a lower actuating portion independently vertically movable, whereby said upper and lower portions can be independently positioned within said space;

upper and lower actuators outside of said space and coupled to said upper and lower actuating portions, respectively; and roller means on said upper and lower actuators for facilitating movement of said upper and lower actuators.

5. An insulated glass window assembly as defined in claim 4 further comprising at least one magnet on each of said upper and lower actuating portions and said upper and lower actuators, said magnets coupling said upper and lower actuators with said upper and lower actuating portions, respectively.

6. An insulated glass window assembly as defined in claim 4 wherein said upper and lower actuators define finger pockets.

7. A window assembly comprising:

a glass panel having first and second opposite sides;

a window covering adjacent one of said sides for movement proximate said one side, said window covering including an upper portion including an upper inner magnet and a lower portion including a lower inner magnet, said upper and lower portions movable independently of one another;

upper and lower actuators on the other side of said glass for movement proximate said other side, said upper actuator including an upper outer magnet magnetically coupled to said upper inner magnet through said glass panel, said lower actuator including a lower outer magnet magnetically coupled to said lower inner magnet through said glass panel, whereby movement of said upper and lower actuators causes movement of said upper and lower window covering portions, respectively; and roller means on selected ones of said actuators for facilitating movement of said selected ones of said actuators.

8. A glass window assembly as defined in claim 7 wherein said upper and lower actuators define finger pockets.

9. A glass window assembly as defined in claim 7 further comprising a frame adapted to support said glass panel, said frame defining grooves, said upper and lower actuators including portions riding within said grooves.

* * * * *